US011620865B2

(12) United States Patent
Johnson et al.

(10) Patent No.: US 11,620,865 B2
(45) **Date of Patent: *Apr. 4, 2023**

(54) ACCESS CONTROL IN A MULTI-TENANT ENVIRONMENT

(71) Applicant: Delphian Systems, LLC, Buffalo Grove, IL (US)

(72) Inventors: Thomas D. Johnson, Lake in The Hills, IL (US); Arkadiusz Zimny, Hampshire, IL (US); Ashok Hirpara, Carol Stream, IL (US)

(73) Assignee: Delphian Systems, LLC, Buffalo Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/811,617

(22) Filed: Jul. 11, 2022

(65) Prior Publication Data

US 2022/0343707 A1 Oct. 27, 2022

Related U.S. Application Data

(63) Continuation of application No. 17/000,629, filed on Aug. 24, 2020, now Pat. No. 11,386,731.

(51) Int. Cl.
*G07C 9/00* (2020.01)
*G07C 9/27* (2020.01)

(52) U.S. Cl.
CPC ..... *G07C 9/00571* (2013.01); *G07C 9/00309* (2013.01); *G07C 9/00896* (2013.01); *G07C 9/27* (2020.01); *G07C 2009/00769* (2013.01)

(58) Field of Classification Search
CPC ..... G07C 9/00571; G07C 9/00309; G07C 9/00896; G07C 9/27; G07C 2009/00769; G07C 9/00904
See application file for complete search history.

(56) References Cited

U.S. PATENT DOCUMENTS 4,811,012 A 3/1989 Rollins
9,047,624 B1 6/2015 Des Jardins et al.
(Continued)

FOREIGN PATENT DOCUMENTS

WO 2017198282 A1 11/2017
WO 2019197491 A1 10/2019

OTHER PUBLICATIONS

Sousa, Pedro Jose and Rafael Tavares, "Wireless Control and Network Management of Door Locks," INEGI, University of Porto, Porto, Portugal, IEEE, pp. 141-142, 2015.
(Continued)

*Primary Examiner* — Nabil H Syed
(74) *Attorney, Agent, or Firm* — Banner & Witcoff, Ltd.

(57) ABSTRACT

An access control system may be deployed at a location in a multi-tenant environment. The access control system may store access control information at one or more of an access control device, an access control bridge device, or an access control server. Tenant-specific access control information may be respectively stored at tenant-specific access control devices to control access to tenant-specific areas of the location. Shared access control information may be stored at shared access control devices to control access to common areas of the location. The access control system may be selectively configured such that an access device, an access control bridge device, or the access control server processes requests for access that are received at the location.

36 Claims, 7 Drawing Sheets

(56) References Cited

U.S. PATENT DOCUMENTS

| | | | |
|---|---|---|---|
| 9,077,716 | B2 | 7/2015 | Myers et al. |
| D778,138 | S | 2/2017 | Meyerhoffer |
| 9,580,931 | B2 | 2/2017 | Myers et al. |
| 9,781,599 | B2 | 10/2017 | Myers et al. |
| 10,083,559 | B2 | 9/2018 | Schoenfelder et al. |
| D839,761 | S | 2/2019 | Schoenfelder et al. |
| 10,490,000 | B2 | 11/2019 | Schoenfelder et al. |
| 10,515,495 | B2 | 12/2019 | Schoenfelder et al. |
| 10,529,156 | B2 | 1/2020 | Myers et al. |
| 2012/0083305 | A1 | 4/2012 | Alexander et al. |
| 2013/0017812 | A1 | 1/2013 | Foster |
| 2014/0298398 | A1 | 10/2014 | Neely |
| 2014/0340196 | A1 | 11/2014 | Myers et al. |
| 2016/0198287 | A1 | 7/2016 | Hulusi |
| 2016/0364927 | A1 | 12/2016 | Barry et al. |
| 2017/0018130 | A1 | 1/2017 | Robinson |
| 2017/0069149 | A1 | 3/2017 | Scheja et al. |
| 2018/0286157 | A1 | 10/2018 | Simcik et al. |
| 2019/0244455 | A1 | 8/2019 | Kim et al. |
| 2019/0259232 | A1 | 8/2019 | Nandakumar |
| 2020/0092676 | A1 | 3/2020 | Kuenzi et al. |
| 2020/0334931 | A1 | 10/2020 | Ashok et al. |
| 2021/0012598 | A1 | 1/2021 | Giebat et al. |

OTHER PUBLICATIONS

Ho, Grant et al., "Smart Locks: Lessons for Securing Commodity Internet of Things Devices," Technical Report No. UCB/EECS-2016-11, http://www.eecs.berkeley.edu/Pubs/TechRpts/2016/EECS-2016-11.html, pp. 1-15, Mar. 12, 2016.

ACCESS CONTROL IN A MULTI-TENANT ENVIRONMENT

CROSS-REFERENCE TO RELATED APPLICATIONS

This application is a continuation of U.S. patent application Ser. No. 17/000,629 entitled "Bridge Device for Access Control in a Multi-Tenant Environment" and filed on Aug. 24, 2020 which is incorporated by reference herein in its entirety

INCORPORATION BY REFERENCE

The following commonly-owned patents and/or patent application publications are hereby incorporated by reference in their entirety: U.S. Pat. Nos. 9,580,931; 9,077,716; 9,407,624; 9,781,599; 10,529,156; and 11,276,258.

TECHNICAL FIELD

Aspects of the present disclosure are generally related to access control systems and are particularly directed to providing access control information using a bridge device in a multi-tenant environment.

BACKGROUND

Wireless electronic locks are increasingly popular replacements for traditional mechanical locks. Traditional mechanical locking systems rely on physical keys for locking and unlocking. Wireless electronic lock systems, however, allow users to perform lock and unlock operations using a variety of electronic access devices such as keyfobs, access cards, and mobile computing devices such as mobile cellular telephones (e.g., "smartphones"). Wireless electronic lock systems also introduce new opportunities for access control including, for example, enhanced security measures to authenticate and authorize individuals, granting access for limited periods of time, and enforcing access control rules.

In a single-tenant environment (e.g., a residential home or free standing business) a single wireless electronic locking system may be installed for the tenant. Accordingly, that wireless electronic locking system may be configured to grant and control access for only those individuals associated with that tenant (e.g., the home or business owner). In a multi-tenant environment, however, access control may be desirable for both the common areas accessible to all tenants (e.g., lobbies, building facilities) as well as the private areas respectively accessible to the individual tenants (e.g., tenant offices). Challenges may arise, however, from installing multiple, different wireless electronic locking systems in a multi-tenant environment. For example, there may be competition for both physical and wireless space. Wireless electronic locking systems may include multiple components beyond the electronic locks themselves including, for example, wireless devices that connect the electronic locks to a remote server. The physical locations for installing such devices may be limited in the multi-tenant environment which may in turn limit the number of wireless electronic locking system that may be installed in the multi-tenant environment. Even if different wireless electronic locking systems can be installed in a multi-tenant environment, however, wireless interference from the different systems may result. In view of these challenges, solutions for providing access control in a multi-tenant environment are needed.

SUMMARY

To overcome the challenges described above, techniques for providing access control in a multi-tenant environment are provided. A wireless electronic locking system may be installed in a multi-tenant environment to provide access control for multiple tenants at the multi-tenant environment. Multiple access control devices (e.g., wireless electronic locks) may be installed at various locations in the multi-tenant environment. Some of the access control devices may control access to common areas of the multi-tenant environment while others may control access to the private areas respectively associated with the individual tenants. One or more bridge devices may also be installed at the multi-tenant environment to wirelessly connect the access control devices to a remote server. For ease of reference, the bridge device and remote server are referred to herein as an access control bridge device and an access control server, respectively.

The access control server may store the access control information for the various tenants of the multi-tenant environment. Such access control information may include, for example, information indicating the users, user groups, devices, and device groups associated with a tenant account. The access control bridge device may replicate this access control information. In other words, the access control bridge device may store a copy of the access control information for those tenants. The access control bridge device may then distribute the particular access control information for an individual tenant to the particular access control devices for that tenant. The access control bridge device may distribute the respective access control information to the access control devices associated with each individual tenant.

In this way, a single wireless locking system may be installed in a multi-tenant environment to service multiple tenants while avoiding the challenges associated with competition for physical and wireless space. The access control bridge device may store the bulk access control information for the various tenants while providing the access control devices with the tenant-specific access control information needed to determine whether or not to grant users access to the common or private areas of the multi-tenant environment.

This summary is not intended to identify critical or essential features of the disclosures herein, but instead merely summarizes certain features and variations thereof. Other details and features will also be described in the sections that follow.

BRIEF DESCRIPTION OF THE DRAWINGS

Some features herein are illustrated by way of example, and not by way of limitation, in the figures of the accompanying drawings and in which like reference numerals refer to similar elements.

DETAILED DESCRIPTION

In the following description of the various embodiments, reference is made to the accompanying drawings identified above and which form a part hereof, and in which is shown by way of illustration various embodiments in which aspects described herein may be practiced. It is to be understood that other embodiments may be utilized and structural and functional modifications may be made without departing from the scope described herein. Various aspects are capable of other embodiments and of being practiced or being carried out in various different ways.

As noted above, solutions for providing access control in a multi-tenant environment are needed. Accordingly, aspects of the disclosure below are provided herein are described by way of example in the context of a floor of a building occupied by multiple tenants. The building floor, in this example includes both common areas (e.g., a lobby) accessible to individuals associated with the various tenants as well as private areas (e.g., office space) accessible to only a particular tenant. As noted below, however, the teachings provided below may be employed in other types of multi-tenant environments.

Figure 1:
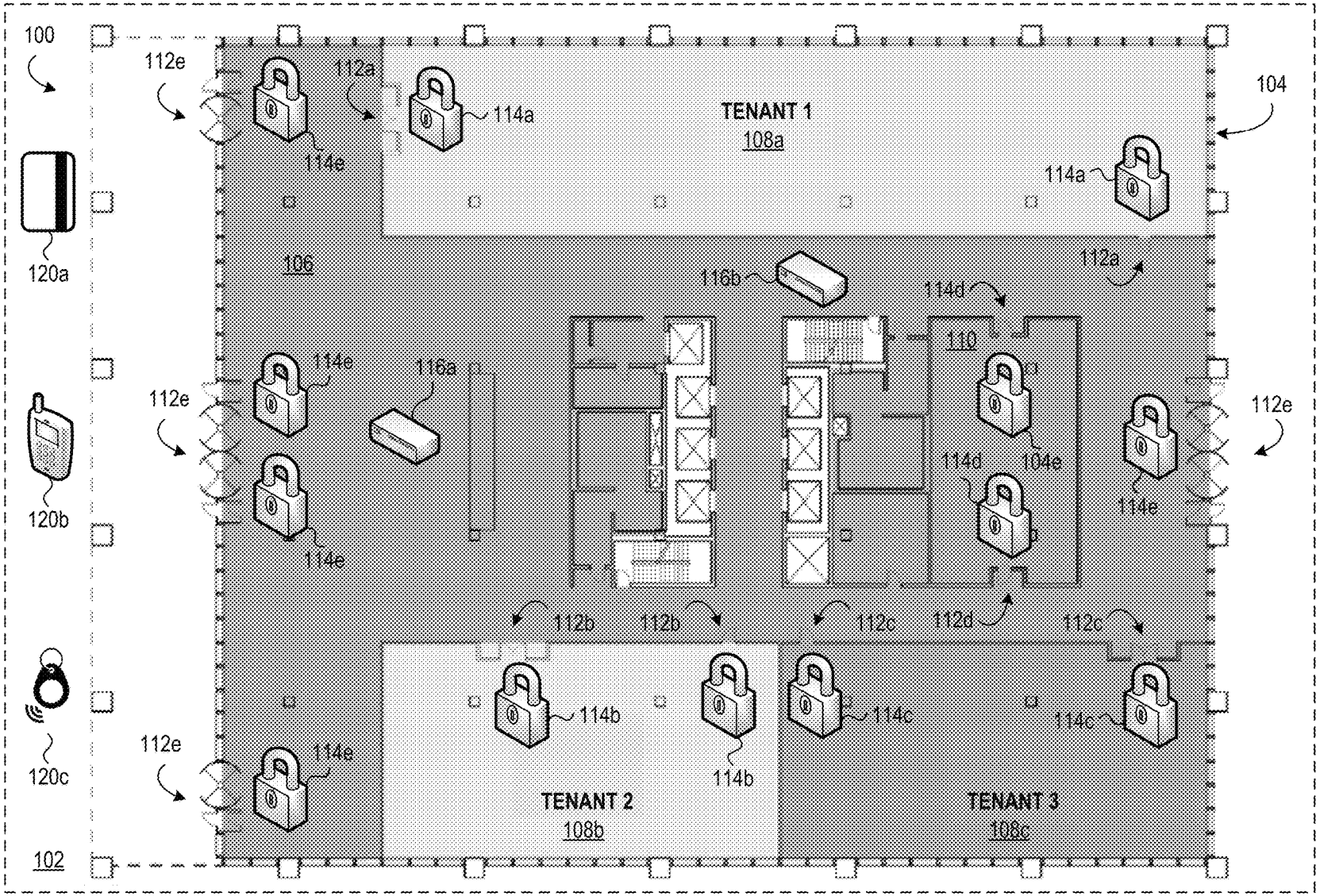
FIG. 1 is a diagram depicting an example access control system in a multi-tenant environment in accordance with aspects of the present disclosure.

Referring now to FIG. 1, a diagram depicting an example access control system 100 installed at a location is shown. In this example, the location includes a multi-tenant environment 102 in accordance with aspects of the present disclosure is shown. A noted above, the multi-tenant environment 102, in this example, is one floor of a physical structure, specifically a building 104. The building 104 includes both a common area 106 and multiple private areas 108*a*—c. The private areas 108*a*—c are respectively associated with one of multiple tenants of this floor of the building 104. For ease of reference, the tenants in this example are referred to as "TENANT 1" which is associated with private area 108*a*, "TENANT 2" which is associated with private area 108*b*, and "TENANT 3" which is associated with private area 108*c*. It will be appreciated that only those individuals associated with a particular tenant should be authorized to access and permitted to access the private area associated with that particular tenant. For example, only those individuals associated with TENANT 1, in this example, should be able to access private area 108*a*. Likewise, only those individuals associated with TENANT 2, in this example, should be able to access private area 108*b*.

As to the common area 106 in this example, individuals associated with each of the tenants should be able to access this area. It will also be appreciated that some multi-tenant environments may include areas that the tenants are not authorized to access. Such areas may include, for example, maintenance, service, and management areas. Accordingly, only maintenance, service, or management personnel may be authorized and permitted to access areas that are otherwise off-limits to the tenants. The multi-tenant environment 102, in this example, includes a management area 110 accessible to only individuals associated with building management.

As seen in FIG. 1, the building 104, in this example, includes multiple access portals 112*a*—e. These access portals 112*a*—e may permit entry to and exit from the building 104 itself (e.g., access portals 112*e*), the private area 108*a* for TENANT 1 (e.g., access portals 112*a*), the private area 108*b* for TENANT 2 (e.g., access portals 112*b*), the private area 108*c* for TENANT 3 (e.g., access portals 112*c*), and the management area 110 (e.g., access portals 112*d*). It will be appreciated that the access portals 112*a*—e may be any type of access portal that can be moved between an open and closed position. Example types of access portals include hinged doors and revolving doors as shown by way of example in FIG. 1 as well as other types of access portals including sliding doors, folding doors, rolling doors, garage doors, windows, gates, panels, and the like.

Figure 2:
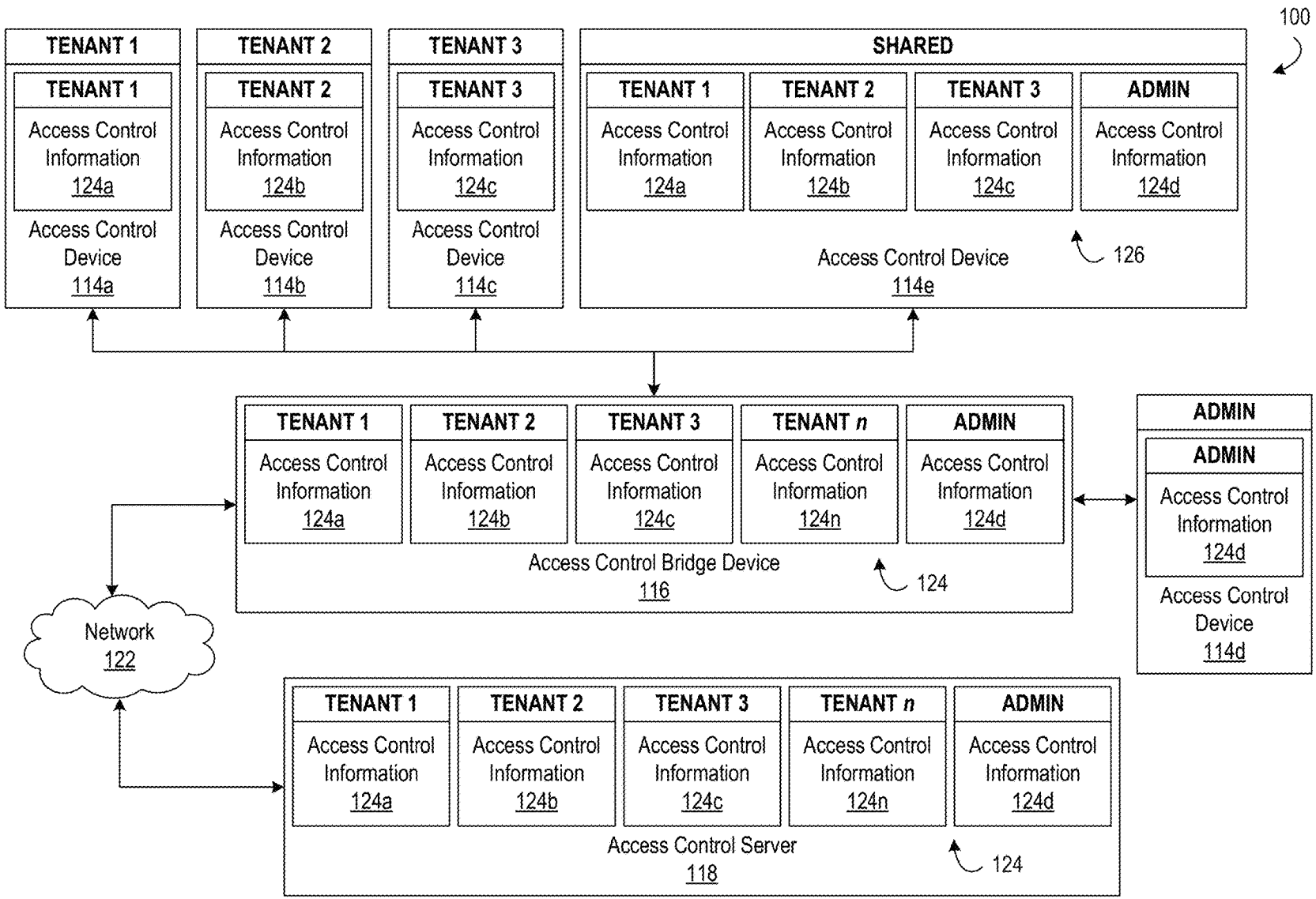
FIG. 2 is a diagram depicting aspects of the example access control system of FIG. 1.

The access control system 100, in this example, includes one or more access control devices 114*a*—e (collectively or generally 114), one or more access control bridge devices 116*a*—b (collectively or generally 116), and an access control server 118 (shown in FIG. 2). The access control devices 114*a*—e may be, for example, wireless electronic locks. As seen in FIG. 1, the access control devices 114*a*—e respectively secure the access portals 112*a*—e. As also seen in FIG. 1, the access control devices 114*a*—e may control access to the building 104 itself (e.g., access control devices 114*e*), the private area 108*a* for TENANT 1 (e.g., access control devices 114*a*), the private area 108*b* for TENANT 2 (e.g., access control devices 114*b*), the private area 108*c* for TENANT 3 (e.g., access control devices 114*c*), and the management area 110 (e.g., access control devices 114*d*). Examples of electronic door locks are described in U.S. Pat. No. 9,580,931 and in commonly-owned U.S. Pat. No. 9,077,715.

One or more access control bridge devices 116*a*—b may be installed at a location to provide wireless coverage at the location. The access control system 100, in this example, includes two access control bridge devices 116*a*—b to provide wireless coverage throughout the multi-tenant environment 102. The access control bridge devices 116*a*—b may provide wireless coverage inside, outside, or both inside and outside the multi-tenant environment, e.g., inside the building 104, outside the building, or both inside and outside the building. It will be appreciated that one or more access control bridge devices may be employed to provide sufficient wireless coverage depending on the size of the location in which the access control system is deployed. One or more of the access control bridge devices 116*a*—b may be in wireless signal communication with one or more of the access control devices 114*a*—e. The access control bridge devices 116 may also be in signal communication with the access control server 118 (FIG. 2). In this way, the access control bridge devices 116 may function as a connection bridge between the access control devices 114*a*—e deployed at the location and the access control server 118. Additional details about the connections and communications between the access control bridge devices 116, the access control devices 114*a*—e, and the access control server 118 are described in further detail below with reference to FIG. 2.

An access device 120*a*—c (collectively or generally 120) may be used to obtain access at the location via one or more of the access control devices 114*a*—e. As shown by way of example in FIG. 1, the access devices 120*a*—c may be an access card 120*a* such as a contact-based or contactless access card, a mobile computing device 120*b* such as a mobile cellular telephone (e.g., a "smartphone"), or a keyfob 120*c*. It will be appreciated that other types of access devices may be used to obtain access at the location including, for example, other types of mobile computing devices (e.g., tablet computing devices, palm-top computing devices, wrist-worn or other body-worn computing devices, body-integrated computing devices), contact-based or contactless access cards, keyfobs, and the like. Examples of access devices are described in commonly-owned U.S. Pat. Nos. 9,077,716, 9,407,624, 9,781,599; 10,529,156; and U.S. patent application Ser. No. 16/901,582.

The access device 120 may be employed to initiate an access request with one or more of the access control devices 114*a*—e. For example, a user may manually initiate an access request using an access control application installed at the access device 120. The access request may be initiated, in this example, by selecting an "UNLOCK" command at the access control application. Additionally or alternatively, a user may manually initiate an access request by inserting the access device 120 (e.g., an access card) into a reader (e.g., an access card reader) of the access control device. Additionally or alternatively, a user may manually initiate an access request by scanning the access device 120 (e.g., a barcode or other visual indicia affixed to, presented on, or display by the access device) with a scanner (e.g., a camera or other optical scanner) of the access device 120. Additionally or alternatively, a user may automatically initiate an access request by bringing the access device 120 within some threshold proximity of the access control device 114*a*—e. In this example, an access control device 114*a*—e may automatically detect the presence of the access device 120 using any suitable techniques including, for example, NFC, periodic wireless pings, and the like. The threshold proximity may be different in particular implementations of the access control system 100. For example, in some implementations the threshold proximity may be on the scale of feet or meters (e.g., within 10 feet), while in other implementations the threshold proximity may be on the scale of inches, centimeters, or millimeters (e.g., within three millimeters). Example implementations that employ manual or automatic access requests are described in the commonly-owned patents and patent applications noted above.

It will be appreciated that the access control system may be deployed in a variety of multi-tenant environments. As noted above, the multi-tenant environment 102 shown by way of example in FIG. 1 is one floor of a building 104. Other types of multi-tenant environments include environments having multiple floors of a physical structure (e.g., an office building, a residential building, a shopping mall, and the like) as well as multiple physical structures (e.g., an office campus, an educational campus, and the like). As also noted above, a multi-tenant environment may include both common areas and private areas. A common area may, for example, may be accessible to individuals associated with multiple tenants (e.g., lobby, public bathrooms, cafeteria, gym, and the like). A private area, on the other hand, may be accessible to only those individuals associated with a particular tenant (e.g., office space, private bathrooms, private storage, and the like). Individuals associated with a particular tenant may include, for example, the resident, the business owner, business employees, customers, guests of the resident or business, service or maintenance personnel (e.g., for deliveries, repairs, cleaning), and building management that requires access to the private space of the tenant, and the like.

The access control devices 114*a*—e and access control bridge devices 116*a*—b of the access control network 100 may include multiple networking interfaces for wired and/or wireless communications. The wireless networking interfaces may enable those components to communicate via a variety of networks including a wired and/or wireless local area network, a wide area network such as the Internet, a cellular network, a satellite network, and the like.

Any suitable wireless communication protocol and/or standard may be employed for the wireless communications between the access control bridge devices 116 and the access control devices 114*a*—e. Some examples of suitable wireless communication protocols and standards that may be employed include the IEEE 802.11 family of wireless LAN standards commonly known as "Wi-Fi," cellular communication standards such as the 2G, 3G, 4G, or 5G generation of cellular communication standards, short-range communication standards such as the IEEE 802.15 family of wireless communication standards which include implementations commonly known as Bluetooth Classic developed by the Bluetooth Special Interest Group (SIG), low-power wireless communication standards include Bluetooth low energy (also known as Bluetooth LE, BLE, and Bluetooth Smart) also developed by the Bluetooth SIG and include ANT developed by Dynastream Innovations Inc., ZigBee developed by the ZigBee Alliance, and any of the near-field communication (NFC) standards developed by the NFC Forum. Accordingly, an access control device and/or access control bridge device may include one or more wireless communication interfaces for wirelessly communicating using one or more of these wireless standards and wireless protocols.

The networking interfaces may also enable the components of the access control network 100 to form a mesh network of interconnected devices for routing messages between and among the access control server 118 (FIG. 2), the access control bridge devices 116*a*—b, the access control devices 114*a*—e, and the access devices 120*a*—c. It will also be appreciated that an access control system may include any combination of the different types of access control devices (or other types of end devices) and access devices such as those described herein. Example access control systems and access control devices are described in commonly-owned U.S. Pat. Nos. 9,077,716; 9,407,624; 9,781,599; and 10,529,156.

Referring now to FIG. 2, aspects of the example access control system 100 of FIG. 1 are shown. As described above, the components of the access control system 100 may be in signal communication with each other. For example, the access control devices 114*a*—e may be in signal communication with one or more of the access control bridge devices 116. As noted above, the access control bridge devices 116 may provide wireless coverage at a location and wirelessly communicate with the access control devices 114*a*—e. The access control bridge devices 116 may, in turn, be in signal communication, via a network 122, with an access control server 118. The access control server 118 may be physically located locally (e.g., in the same building) or remotely (e.g., in a different building) relative to the access control bridge device. Accordingly, the network 112 may include one or more of a local area network (LAN) or wide area network (WAN) such as the Internet or a cellular network.

The access control server 118 in FIG. 2 stores access control information 124 for the tenants of the multi-tenant environment. For example, the access control information 124, in this example, includes access control information 124*a* for TENANT 1, access control information 124*b* for TENANT 2, access control information 124*c* for TENANT 3, access control information 124*n* for TENANT n, and the access control information 124*d* which may be associated with an account for the entity that oversees the administration (e.g., management) of the multi-tenant environment. Accordingly, the access control information 124*d* is described herein as being associated with an "ADMIN" of the multi-tenant environment. The access control server 118 may thus maintain the "master" copy of the access control information 124 for the tenants and access devices of the access control system 100.

The access control bridge devices 116 may replicate the access control information 124 stored at the access control server 118. Accordingly, the access control bridge devices 116 may store the respective access control information 124*a*—d and 124*n* for each of the tenants and administrative entity. The access control bridge devices 116 may use an access control protocol to obtain the access control information 124 from the access control server 118 as well as any updates to the access control information (e.g., the addition or removal of accounts, users, access devices, access control devices, user groups and device groups). The access control bridge devices 116 may likewise use the access control communication protocol to distribute the access control information to the individual access control devices 114. As seen in FIG. 2, the individual access control devices 114 may store the respective access control information 124 for the corresponding tenant. For example, the access control device 114*a* stores the access control information 124*a* for TENANT 1, the access control device 114*b* stores the access control information 124*b* for TENANT 2, the access control device 114*c* stores the access control information 124*c* for TENANT 3, and the access control device 114*d* stores the access control information 124*d* for the ADMIN. In this way, the access control devices 114*a*—d may grant access to only those individuals associated with a particular tenant. In a multi-tenant environment, an access device may need to control access for multiple tenants. For example, an access control device for an exterior door may control access for individuals associated with each tenant of the multi-tenant environment. This type of access device (e.g., access control device 114*e*) may thus be referred to as a "shared" access control device by virtue of its access control for a common area of the multi-tenant environment that the tenants share to control access to that common area. To control access to a common area, access control device 114*e* may likewise replicate the access control information 124 that is stored at the access control server 118. As seen in FIG. 2, for example, the access control device 114*e* stores access control information 124*a*—d for the TENANT 1-3 and the ADMIN. The access control device 114*e* may also store the access control information 124*n* for TENANT n which has been omitted for the sake of clarity.

Access control information associated with a specific tenant may thus be referred to as tenant-specific access control information. Similarly, access control information associated with a shared access control device (e.g., shared access control device 114*e*) may thus be referred to as shared access control information. The shared access control information stored at a shared access control device may include some or all of the access control information associated with one or more tenants (including the administrative entity) of a multi-tenant environment. As seen in FIG. 2, for example, shared access control device 114*e* stores shared access control information 126 which includes access control information 124*a*—d for the TENANT 1-3 and the ADMIN. It will be appreciated, however, that in some implementations, an access control device may not store any access control information and instead rely on the access control bridge device to determine whether to grant or deny an access request based on the access control information replicated at the access control bridge device. As described in further detail below, a tenant may selectively configure its access control devices such that an access request is handled by the access control device 114, an access control bridge device 116, or the access control server 118.

Figure 3:
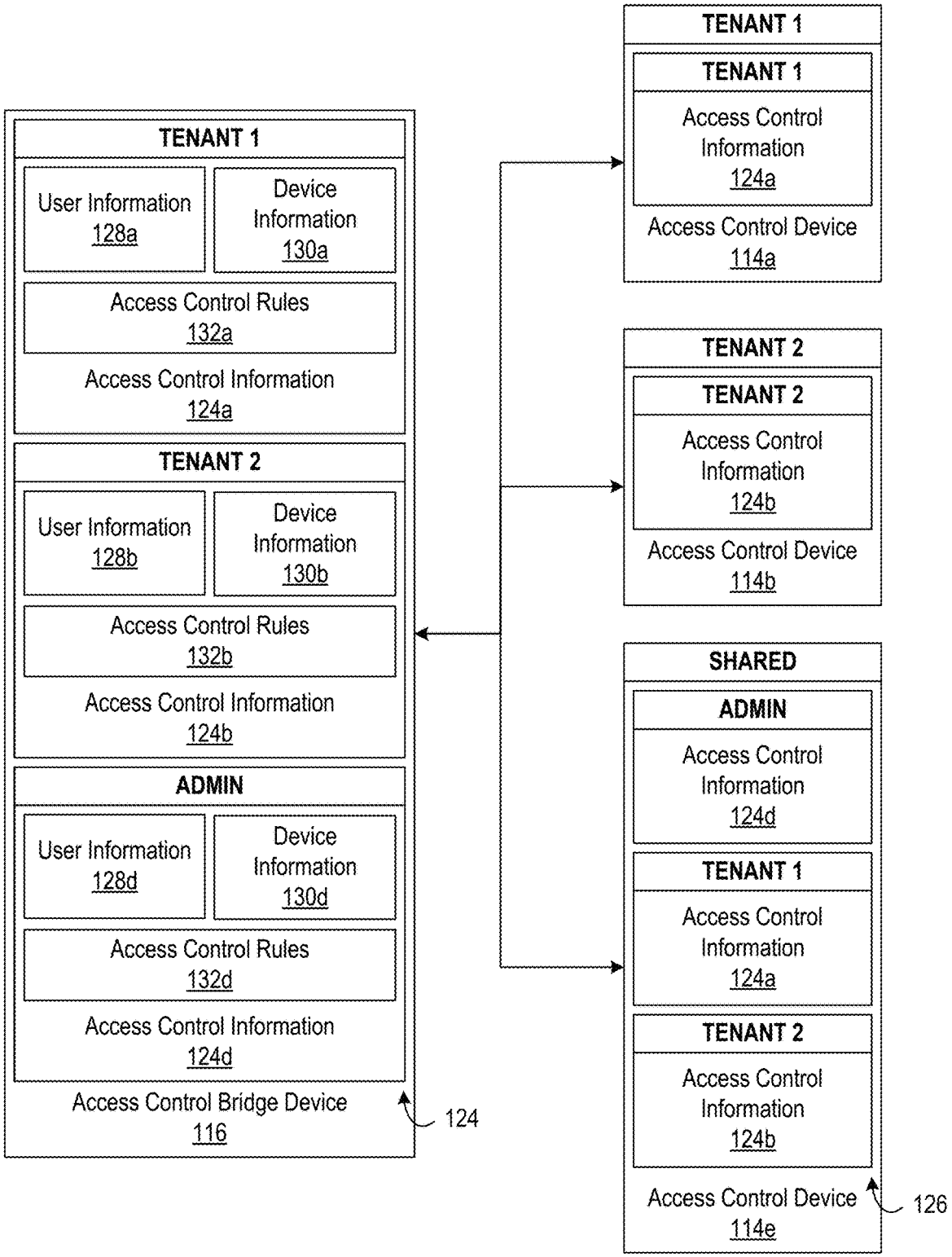
FIG. 3 is a diagram depicting aspects of the example of access control information of FIG. 2.

Referring now to FIG. 3, aspects of the access control information of FIG. 2 is shown. For the sake of clarity, only access control information 124*a*—b and 124*d* respectively associated with TENANT 1, TENANT 2, and the ADMIN from FIG. 2 is shown. It will be appreciated, however, that the disclosures provided with reference to FIG. 3 are likewise applicable to the access control information 124*c* and 124*n* for TENANT 3 and TENANT n from FIG. 2. Access control information may include information indicating or otherwise associated with the accounts for the tenants of the multi-tenant environment. Access control information may thus include user information 128*a*—b and 128*d*, device information 130*a*—b and 130*d*, and access control rules 132*a*—b and 132*d*. As seen in FIG. 3, access control information 124 for TENANT 1 may thus include user information 128*a*, device information 130*a*, and access control rules 132*a*, access control information 124*b* for TENANT 2 may thus include user information 128*b*, device information 130*b*, and access control rules 132*b*, and the access control information 124 for the ADMIN may thus include user information 128*d*, device information 130*d*, and access control rules 132*d*.

An individual tenant, for example, may be associated with an individual account. An account may be associated with one or more users and one or more access control devices (e.g., each of a mobile phone, an access card, and a keyfob).

User information may include information about users and user groups. For example, the user information may indicate the individuals associated with the account for a particular tenant. The user information for those individuals may include, for example, a unique user identifier and bibliographic information (e.g., first name, last name). One or more user groups may be defined for an account (e.g., an "owner" user group and an "employee" user group). A user may be associated with one or more user groups, and a user group may include one or more users. \

Device information may include information about access devices, access control devices, and access control device groups. For example, the device information for those devices may include a unique device identifier (e.g., serial number, media access control address) and descriptive information. An individual user may be associated with one or more access devices. One or more access control device groups may be defined for an account (e.g., an "exterior" access control device group and an "interior" access control device group). An access control device may be associated with one or more access control device groups, and an access control device group may be associated with one or more access control devices.

Access control rules may, for example, specify one or more first-in conditions, specify access schedules and the like. A first-in condition may specify one or more of a user, user group, access device, or access device group that must first be granted access before any subsequent user or access device. For example, a first-in condition may specify that the manager of a business must be the first individual granted access to the business on a given day. An access schedule may specify one or more dates, date ranges, times, or time windows that access can be granted for one or more of a user, user group, access device, or access device group. For example, an access schedule may specify that cleaning personnel can access a tenant area Monday through Friday between 7:00-9:00 PM. Other examples will be appreciated with the benefit of this disclosure.

By distributing the access control information to the corresponding access control devices as shown by way of example in FIGS. 2 and 3, the access control devices 114, the access control bridge devices 116, and the access control server 118 may respectively possess the user information, device information, and access control rules used to process an access request. The access control system 100 (FIG. 1) may thus perform an access control procedure in response to an access request from an access device 120. The access control procedure may include one or more of an authentication procedure and an authorization procedure. During the authentication procedure, the identity of the access device and/or its user may be verified. During the authorization procedure, one or more access control rules may be applied to determine whether a verified access device or verified user should be granted access via the access control device.

The access control system 100 (FIG. 1) may be selectively configurable to indicate which component should perform the access control procedure. For example, an access control device 114 may be selected to perform an access control procedure locally at the location. As another example, an access control bridge device 116 may be selected to perform an access control procedure semi-locally at the location. As a further example, the access control server 118 may be selected to perform an access control procedure remotely relative to the location. In this way, an access control procedure may be performed at the level of the access control device 114, the level of the access control bridge device 116, and/or the level of the access control server 118. For example, one or more access control devices 114 may be selected to perform an access control procedure while one or more access control bridge devices 116 and/or the access control server 118 may also be selected to perform an access control procedure.

The selective configuration of which device of the access control system 100 performs an access control procedure may enhance the security of the access control system. For relatively more sensitive access control devices—e.g., those that control access via exterior doors at the location—access control information may not be stored at those access control devices. Instead, the access control information may be stored at an access control bridge device, and those more sensitive access control devices may rely on that access control bridge device to process the access requests they receive. By storing the access control information at an access control bridge device rather than the access control device itself, the risk of unauthorized individuals acquiring access control information from the local access control devices or obtaining unauthorized access at the location can thus be avoided or at least mitigated. For relatively less sensitive access control devices—e.g., those that control access some interior doors such as bathroom doors—access control information may be stored at those access control devices which may handle the access requests they receive. An access control system (e.g., access control system 100 of FIG. 1) may thus be selectively configured such that access control devices may or may not be selected to perform an access control procedure depending on the desired level of security at the location.

Selecting an access control device to perform an access control procedure may result in relatively faster responses to access requests as compared to selecting an access control bridge device or access control server to perform an access control procedure. This may be due to the latency associated the communications exchanged between the devices of the access control system. It will thus be appreciated that security and response time are trade-offs that may be considered when configuring which devices of an access control system are selected to perform an access control procedure or aspects of an access control procedure.

In the access control system 100, aspects of an access control procedure may be distributed across an access control device 114, access control bridge device 116, and/or the access control server 118. For example, an access control device 114 may be selected to perform an authentication procedure while an access control bridge device 116 (or access control server 118) may be selected to perform an authorization procedure. As another example, an access control bridge device 116 may be selected to perform an authentication procedure while the access control server 118 may be selected to perform an authorization procedure. Additional and alternative distributions of the authentication and authorization procedures across the access control devices, access control bridge devices, and access control server are contemplated and will be appreciated with the benefit of these disclosures.

As noted above, some access control devices 114 may be selected to perform the access control procedure while others may not be selected to perform the access control procedure. As one illustrative example, consider access control devices that respectively control access via exterior doors (e.g., access control devices 114*e*) and interior doors (e.g., access control devices 114*a*—d) at the location. The access control devices that control access via the exterior doors may be configured such that any requests for access are processed by semi-locally by an access control bridge device 116 at the location while the while the access control devices that control access via the interior doors may be selected to locally process requests for access. Additional and alternative examples will be appreciated with the benefit of this disclosure.

One or more configuration settings at an access control device, access control bridge device, or access control server may indicate which device of an access control system has been selected to perform an access control procedure and/or one or more aspects of an access control procedure. Global configuration settings applicable to all access control devices of an access control system may be used. Semi-global configuration settings applicable to one or more access control devices belonging to one or more access control device groups may additionally or alternatively be employed. Individual configuration settings uniquely applicable to particular access control devices may additionally or alternatively be employed. A configuration setting may be set (e.g., updated) via a dashboard interface that may be presented, e.g., at an access device (e.g., access device 120 in FIG. 1), a web browser, and the like. A configuration setting may be provided, for example, via direct communication or by routing a message with the configuration setting through a mesh network established between the devices of an access control system. The configuration setting may be received directly from an access device (e.g., access device 120 in FIG. 1) or indirectly from an access control server (e.g., access control server 118 in FIG. 2).

As noted above, an access control system may employ an access control communication protocol to obtain and distribute the access control information. The access control communication protocol may be implemented by the access control devices, the access control bridge devices, and the access control server of the access control system. The access control system may also be configured with various access control logic to process access requests. The access control logic may also be implemented by the access control devices, the access control bridge devices, and the access control server of the access control system. Aspects of the access control logic and access control communication protocol are described below. As noted above, the access control communication protocol and the access control logic may be implemented by one or more of the access control devices, the access control bridge devices, and/or the access control server in an access control system.

The access control logic may include logic to determine whether or not to verify access. This may include determining whether the user has been disabled from accessing the access control system, determining whether the access control device has been disabled from granting access, and obtaining the access rules for the access control device. If the user or the access control device has been disabled, then access may be denied. If there are no access rules for the access control device, then access may be denied. The access control rules for an access control device may fall into one of two groups: those without first-in conditions and those with first-in conditions. Each access control rule of these two groups may be iterated over and applied to determine whether or not to grant access. For example, the access control rules without first-in conditions may be iteratively applied first. If an access control rule without a first-in condition is found that grants access, then access may be granted. If not, the access control rules with first-in conditions may be iteratively applied next. If an access control rule with a first-in condition is found that grants access, then access may be granted. Otherwise access may be denied.

The access control logic may include logic to apply an access control rule. This may include determining whether the access control rule is has been disabled, confirming that the access control device is affected by the access control rule, confirming that the user is affected by the access control rule, obtaining any schedules that permit access at the time the access request is received, and verifying that any applicable first-in conditions for the access control rule have been satisfied. If the rule is not enabled, if the access control device is not affected by the rule, if the user is not affected by the rule, or if there are no schedules that permit access at the time the access request is received, then the access control logic may indicate that access should be denied. Verifying that an applicable first-in condition has been satisfied may include iterating over the obtained schedules to identify the earliest date and/or time that permits access and searching an audit log for an access record that satisfies the first-in condition of the earliest schedule that permits access. If the no earliest date and/or time can be found, then the access control logic may indicated that access should be denied. Otherwise, an audit log may be searched for a record that satisfies the first-in condition for the earliest schedule that permits access. Determining whether an audit log record satisfies that first-in condition may include determining whether the access request is received within the timeframe allowed by the schedule and determining whether the first-in condition is satisfied by the user, a user group of user, the access control device, and/or a device group of the access control device. If an audit log record is found, the access control logic may indicate that access should be granted. Otherwise, the access control logic may indicate that access should be denied.

The access control logic may include logic configured to determine whether an access control device is affected by an access control rule, in other words whether the access control rule applies to the access control device. This may include determining whether the access control rule affects all access control devices, determining whether the access control rule specifies a device group of the access control device, and determining whether the access control rule specifies the individual access control device itself. If the access control rule applies to all access control devices, specifies a device group of the access control device, or specifies the access control device itself, then the access control logic may indicate that the access control device is affected by the access control rule. Otherwise, the access control logic may indicate that the access control device is not affected by the access control rule.

The access control logic may include logic configured to determine whether a user is affected by an access control rule, in other words whether the access control rule applies to the user. This may include determining whether the access control rule affects all users, determining whether the access control rule specifies a user group of the user, and determining whether the access control rule specifies the individual user itself. If the access control rule applies to all users, specifies a user group of the user, or specifies the user itself, then the access control logic may indicate that the user is affected by the access control rule. Otherwise, the access control logic may indicate that the user is not affected by the access control rule.

The access control logic may include logic to obtain, provide, or otherwise identify, for an access control rule, any associated schedules that permit access at the time the access request is received. This may include obtaining the current date and time and iterating over the schedules associated with the access control rule to determine which schedules permit access at the time the access request is received. A schedule may be a weekly schedule that specifies one or more days of the week. A weekly schedule may be an "all day" schedule or specify a timeframe (e.g., start time, end time). A schedule may alternatively specify a date range and indicate that it is an "all day" schedule or otherwise specify a timeframe (e.g., start time, end time). A weekly schedule may permit access at the time the access request is received where the schedule is an "all day" weekly schedule and the current day matches a day specified in the schedule or where the schedule is a "timeframe" weekly schedule and the current time falls within the timeframe specified in the schedule. A "date range" schedule may permit access at the time the access request is received where the current date falls within the date range specified in the schedule and either the schedule is an "all day" schedule or the current time falls within the timeframe specified in the schedule. The access control logic may return a list of the schedules that permit access at the time the access request is received.

The access control logic may include logic to determine whether a first-in condition is met for a list schedules that permit access at the time an access request is received. This may include obtaining the current date and time, iterating over the list of schedules to determine the earliest possible start time for those schedules, and determining whether an audit log includes a record indicating access after that start time. Schedules that provide access 24 hours a day, seven days a week may be ignored. The access control logic may provide or otherwise identify the earliest possible start time for the list of schedules if one is found in the list of schedules.

The access control logic may include logic to obtain, provide, or otherwise identify a first-in record in an audit log of processed access requests. To determine which processed access request corresponds to a first-in access, information indicating the earliest possible start time, a user, a user group, an access control device, or a device group may be used. Determining the first-in record may include obtaining from the audit log any records indicating that an access request was processed after the earliest possible start time, filtering those records by user or user group (if specified), filtering those records by access control device or device group (if found), and selecting the record associated with the earliest processed access request as the first-in record.

The access control communication protocol may implement a specification for messages transmitted to an access control bridge device. These messages may be employed to indicate to an access control bridge device access control information and updates to the access control information, e.g., the enabled/disabled status of a user or access control device, user groups and device groups, access control rules, first-in conditions, schedules, and access devices associated with a user. The messages may include: a message identifying one or more access control devices (e.g., serial number, enabled/disabled status, update number and type, and account identifier), a message identifying one or more device groups (e.g., device group identifier, device group number, list of associated access control device identifiers, update number and type, and account identifier), a message indicating a member of a device group (e.g., device group identifier, access control device identifier, update type), a message indicating one or more updates to one or more device groups (e.g., device group identifier, device group number, list of access control devices to add, list of access control devices to remove, update number and type), a message indicating one or more user access devices (e.g., user identifier, access device identifier, device type, globally unique access device identifier, access code, update number and type), a message indicating one or more users (e.g., user identifier, enabled/disabled status, list of associated access devices, update number and type, account identifier), a message indicating one or more user groups (e.g., user group identifier, user group number, list of associated user identifiers, update number and type, account identifier), a message indicating one or more updates to one or more user groups (e.g., user group identifier, user group number, list of user identifiers to add, list of user identifiers to remove, updated number and type), a message indicating one or more user group members (e.g., user group identifier, user identifier, update type), a message indicating a first-in condition (e.g., first-in condition identifier, access control rule identifier, "any user" flag, user identifier, user group identifier, user group number, "any device" flag, access control device serial number, device group identifier, device group number, minutes threshold, update number and type), a message indicating one or more schedules (e.g., schedule identifier, rule identifier, schedule type, day of the week, start date, end date, "all day" flag, daily start time, daily end time, time zone adjustment, update number and type), a message indicating one or more access control rules (e.g., rule identifier, enabled/disabled status, "all user" flag, "all device" flag, remote operation flag, first-in condition rule, list of device group identifiers, list of access control device identifiers, list of user identifiers, list of user group identifiers, list of schedule identifiers, update number and type, account identifier), and a message indicating one or more updates to one or more access control rules (e.g., rule identifier, enabled/disabled status, "all user" flag, "all device" flag, remote operation flag, first-in condition rule, list of device groups to add, list of device groups to remove, list of access control devices to add, list of access control devices to remove, list of users to add, list of users to remove, list of user groups to add, list of user groups to remove, list of schedules to add, list of schedules to remove, update number and type).

The access control communication protocol may also implement request-response messaging an access control bridge device may employ to obtain the access control information from an access control server. An access control bridge device may use this messaging to obtain the access control information in its entirety (e.g., during an initial setup and initial configuration) and to periodically or intermittently obtain updates to the access control information (e.g., during normal operation after the initial deployment and setup). An access control bridge device may thus check for updates to the access control information at the access control server on a regular or irregular basis.

Such messaging may include: messages to request and receive account information for an account of the access control system (e.g., the total number of users, user groups, access control devices, and device groups associated with the account), messages to request and receive access control rules for an account (e.g., a list of access control rules associated with the account), messages to request and receive a specified set of user records for an account (e.g., a list of the specified users), messages to request and receive a specified set of user groups for an account (e.g., a list of the specified user groups), messages to request and receive a specified set of access control devices for an account (e.g., a list of the specified access control devices), messages to request and receive a set of device groups for an account (e.g., a list of the specified device groups), messages to request and receive update information for all records associated with an account (e.g., update information for associated users, user groups, access control devices, and device groups), messages to request and receive updates for one or more users, messages to request and receive updates for one or more user groups, messages to request and receive updates for one or more access control devices, messages to request and receive updates for one or more device groups, messages to request and receive access control rules with available updates, messages to request and receive update information for a particular access control rule, messages to request and receive information for any schedules associated with a particular access control rule, messages to request and receive information about any updates for a particular schedule, messages to request and receive information indicating whether a first-in condition for an access control rule has been satisfied, messages to request and receive a new cryptography key, messages to push updates to access control rules to one or more access control bridge devices associated with an account, messages to push a delete or reset message to one or more access control bridge devices, and messages to request and receive a list of access control devices (which may be respectively associated with different accounts) for which an access control bridge device manages the associated access control data.

The requests sent by an access control bridge device may specify, as needed depending on the what information is being requested, one or more identifiers (e.g., for an account, access control rule, first-in condition, schedule, user, user group, access control device, device group), one or more current update numbers the access control bridge device possesses for a particular account (e.g., for a user, user group, access control device, device group), a desired starting position for the requested records, and a desired return count for the requested records. The responses received by an access control bridge device may include, depending on what information was requested, a list of accounts (e.g., account identifier, globally unique account identifier, account type), a total number of components for a particular account (e.g., the total number users, total number of user groups, total number of access control devices, total number of device groups), the highest update number available for the components of a particular account (e.g., highest user update number, highest user group update number, highest access control device update number, highest device group update number), list of access control rule identifiers and the highest update number for each access control rule, list of schedule identifiers, and a payload with the requested information. The payloads may include the messages described above for providing the access control information and its associated updates.

Figure 4:
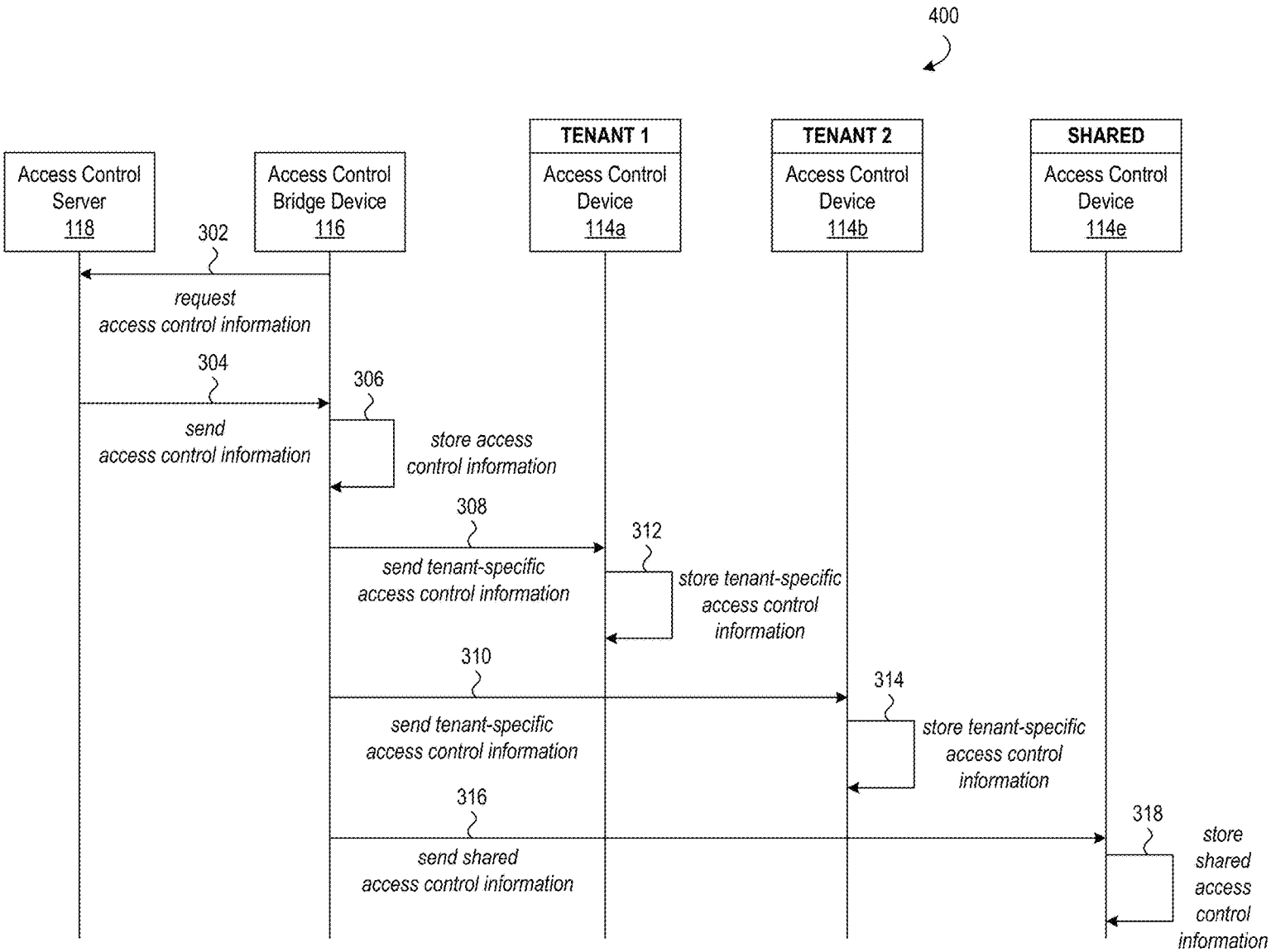
FIG. 4 is a diagram depicting an example sequence of method steps for distributing access control information in accordance with aspects of the present disclosure.

Referring now to FIG. 4, an example sequence 400 of method steps for distributing access control information procedure is shown. As shown in FIG. 4, an access control bridge device 116 may obtain access control information from an access control server 118 and distribute the portions of the obtained access control information to an access control device 114*a* associated one tenant (e.g., "TENANT 1"), an access control device 114*b* associated with another tenant (e.g., "TENANT 2"), and a shared access control device 114*e* that controls access for multiple tenants (e.g., "SHARED"). The access control server 118, access control bridge device 116, and access control devices 114*a*—b and 114*e* may be configured to employ an access control communication protocol such as that described above to distribute the access control information in the access control system.

As seen in FIG. 4, an access control bridge 116 may send a request for access control information to the access control server 118 (302). Based on receiving the request for access control information, the access control server 118 may send the access control information to the access control bridge device 116 in response (304). The request for access control information may be a request for all access control information associated with one or more accounts of the access control system. The request for access control information may be a request for particular access control information associated with one or more of the accounts. The access control bridge device 116 may send one or more messages to the access control server to request the access control information. Similarly, the access control server may send one or more messages to the access control bridge device with access control information in response to the requests. The access control bridge device 116 may request access control information from the access control server 118 at regular or irregular intervals or based on a triggering event. The triggering event may be, for example, an access request at one of the access control devices of the access control system. The access control server 118 may also push access control information to the access control bridge device 116 without a request from the access control bridge device.

The access control bridge device 116 may store the access control information received from the access control server 118 (306). As described above, the access control bridge device 116 may store the access control information associated with multiple tenants of the location at which the access control system is deployed. The access control bridge device 116 may send tenant-specific access control information to the respective tenant-specific access control devices 114*a*—b (308 and 310). The tenant-specific access control devices 114*a*—b may thus store the tenant-specific access control information received from the access control bridge device. For example, access control device 114*a* may store the tenant-specific access control information for its associated tenant (e.g., "TENANT 1") (312), and access control device 114*b* may store the tenant-specific access control information for its associated tenant (e.g., "TENANT 2") (314). In this way, the access control bridge device 116 may configure the respective access control devices 114*a*—b to grant access to only those users associated with the respective tenants. The access control bridge device may also send shared access control information to the shared access control device 114*e* (e.g., "SHARED") (316), and the shared access control device may store the shared access control information it receives (318). As described above, the shared access control information may include tenant-specific access control information for multiple tenants of the location. In this way, the access control bridge device 116 may configure the shared access control device 114*e* to grant access to one or more users associated with multiple tenants of the location.

Figure 5:
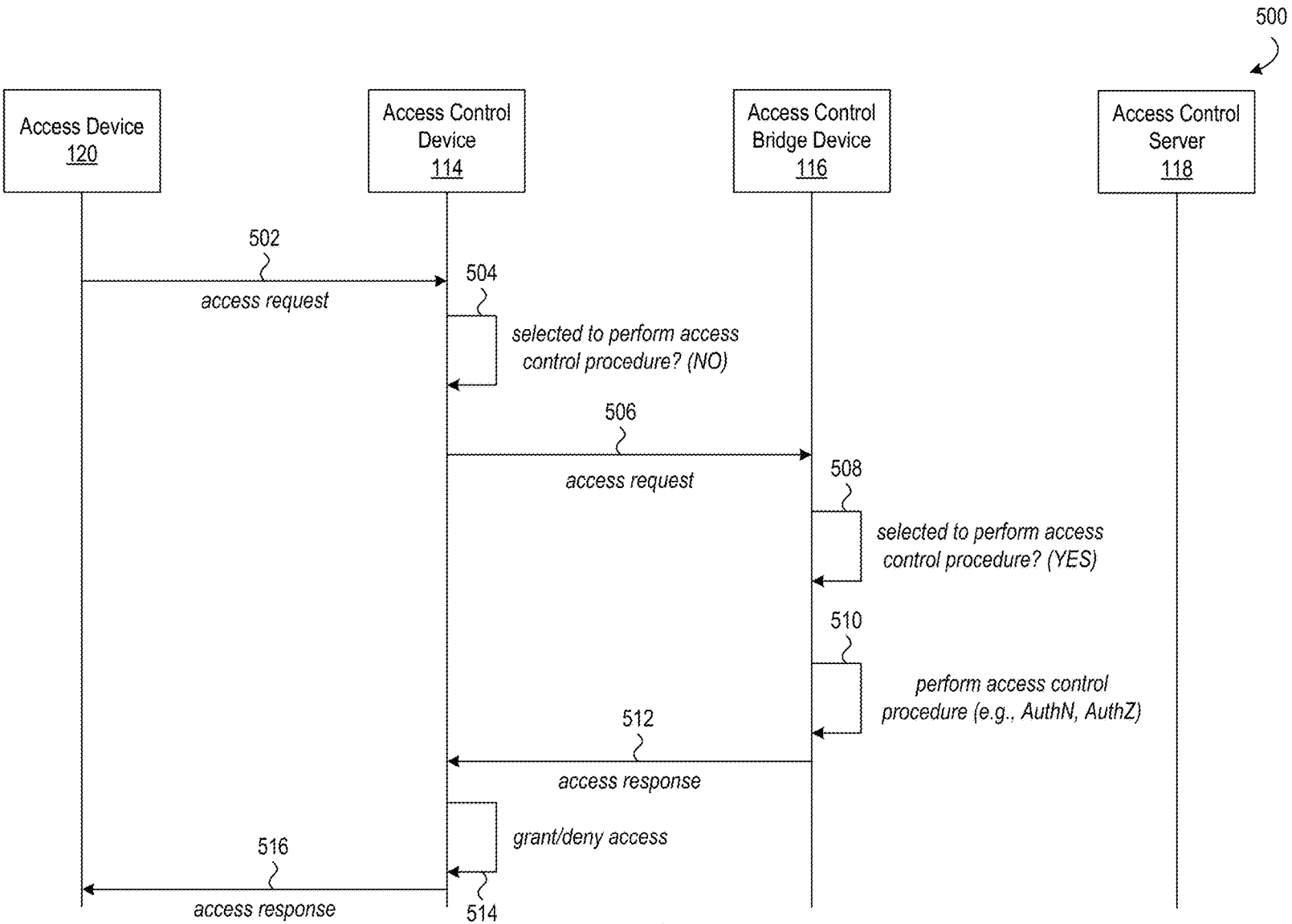
FIG. 5 is a diagram depicting an example sequence of method steps for performing an access control procedure in accordance with aspects of the present disclosure.

Referring now to FIG. 5, an example sequence 500 of method steps for performing an access control procedure is shown. In this example, the access control system is configured such that an access control bridge device 116 is selected to perform an access control procedure rather than an access control device 114. An access device 120 (e.g., access device 120*b* of FIG. 1), may provide an access request to an access control device (e.g., tenant-specific access control device 114*a* or shared access control device 114*e* of FIG. 1) (502). As noted above, the access device 120 may provide the access request in response to some triggering event such as receiving user input at the access device or the access device coming within some threshold distance of the access control device 114. Accordingly, the access device may provide the access request automatically or manually based on receiving user input. The access request may include credentials for one or more of the user (e.g., username, password, PIN) or the access device 120 (e.g., device identifier, MAC address, cryptographic key(s)).

Having received the access request, the access control device 120 may determine whether it has been selected to perform an access control procedure (504). As noted above, the access control procedure may include one or more of authentication of the user, authentication of the access device, authorization of the user, or authorization of the access device. To do this, the access control device 120 may evaluate a configuration setting for the access control device (or the user, or the account). If the access control device 120 has not been selected to perform the access control procedure (e.g., "NO" or 0 or false), then the access control device may forward the access request to the access control bridge device 116 (506). The access request forwarded to the access control bridge device 116 may include the credentials received from the access device 120.

Having received the forwarded access request, the access control bridge device 116 may similarly determine whether it has been selected to perform an access control procedure (508). The access control bridge device 116 may likewise evaluate a configuration setting for the access control bridge device (or the user, or the account). If the access control bridge device 116 has been selected to perform the access control procedure (e.g., "YES" or 1 or true), then the access control bridge device may perform the access control procedure (510), which may include one or more of authentication or authorization of the user and/or the access device 120.

By performing the access control procedure, the access control bridge device 116 may determine whether to grant or deny access via the access control device. The access control bridge device 116 may determine to grant access upon successful authentication and successful authorization of the user and/or access device 120. The access control bridge device may determine to deny access upon unsuccessful authentication (e.g., incorrect password, incorrect PIN) or unsuccessful authorization (e.g., violation of an access control rule, outside of a permitted access control schedule). The access control bridge device 116 may then send an access response back to the access control device 114 (512). Where access is denied, the access response may indicate a reason why (e.g., authentication failed, authorization failed). Having received the access response, the access control device 114 may grant or deny access (514) based on the access response received from the access control bridge device 116. In some examples, the access control bridge device may forward the access response to the access device 120 (516) in order to, e.g., present, at the access device, the reason why access was denied.

Figure 6:
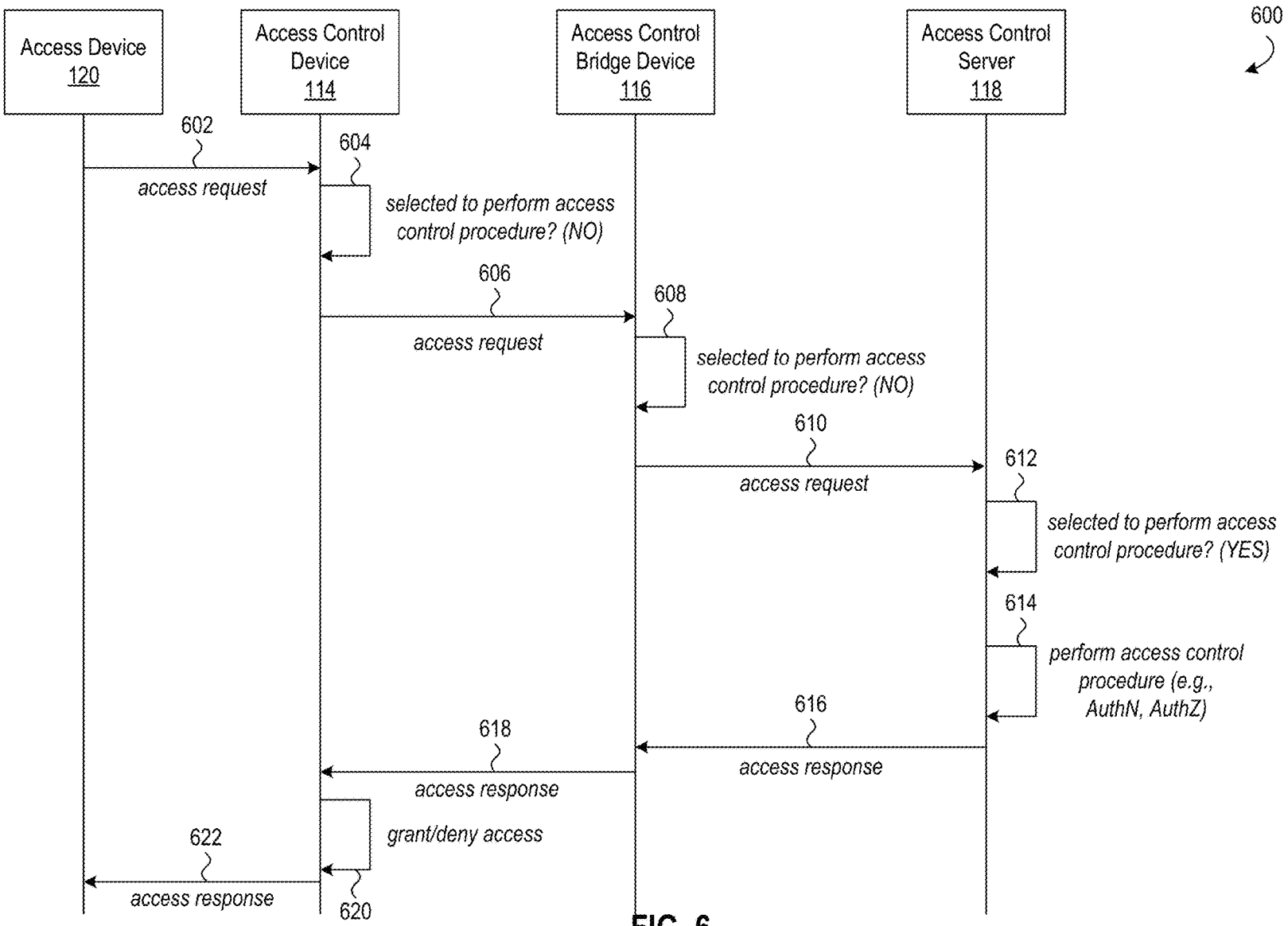
FIG. 6 is a diagram depicting another example sequence of method steps for performing an access control procedure in accordance with aspects of the present disclosure.

Referring now to FIG. 6, another example sequence 600 of method steps for performing an access control procedure is shown. In this additional example, the access control system is configured such that an access control server 118 is selected to perform an access control procedure rather than the access control device 120 or the access control bridge device 116. Like FIG. 5 above, an access device 120 may provide an access request to an access control device (602). Having received the access request, the access control device 120 may determine whether it has been selected to perform an access control procedure (604). If not, then the access control device 120 may forward the access request to the access control bridge device 116 (606). Having received the access request, the access control bridge device 116 may likewise determine whether it has been selected to perform an access control procedure (608). If not, then the access control bridge device 116 may similarly forward the access request to the access control server 118 (610). The access request forwarded to the access control server may include the credentials received from the access device 120.

Having received the access request, the access control server 118 may confirm that it has been selected to perform an access control procedure (612). If so, then the access control server may perform an access control procedure (e.g., one or more of authentication or authorization) (614) in order to determine whether to grant or deny access via the access control device. The access control server 118 may then send an access response back to the access control device 116 (616) indicating whether to grant or deny access. The access control bridge device 116 may similarly forward the access response back to the access control device 114 (618). Having received the access response, the access control device 114 may similarly grant or deny access (620) based on the access response received. Again, in some examples, the access control bridge device may forward the access response to the access device (622) in order to, e.g., present the reason why access was denied.

As noted above, an access control system may be configured such that aspects of an access control procedure are distributed between the access control device 114, the access control bridge device 116, and the access control server 118. For example, an access control system may be configured such that an access control device 114 is selected to perform authentication while an access control bridge device 116 or the access control server 118 is selected to perform authorization (e.g., enforce access control rules, enforce access control schedules). As another example, an access control system may be configured such that an access control device 114 is selected to perform authorization while an access control bridge device 116 or the access control server is configured to perform authentication. As a further example, an access control system may be configured such that one access control device is configured to perform both authentication and authorization, while another access control device is configured to perform only one of authentication or authorization and rely on the access control bridge device or access control server to perform the counterpart procedure.

Figure 7:
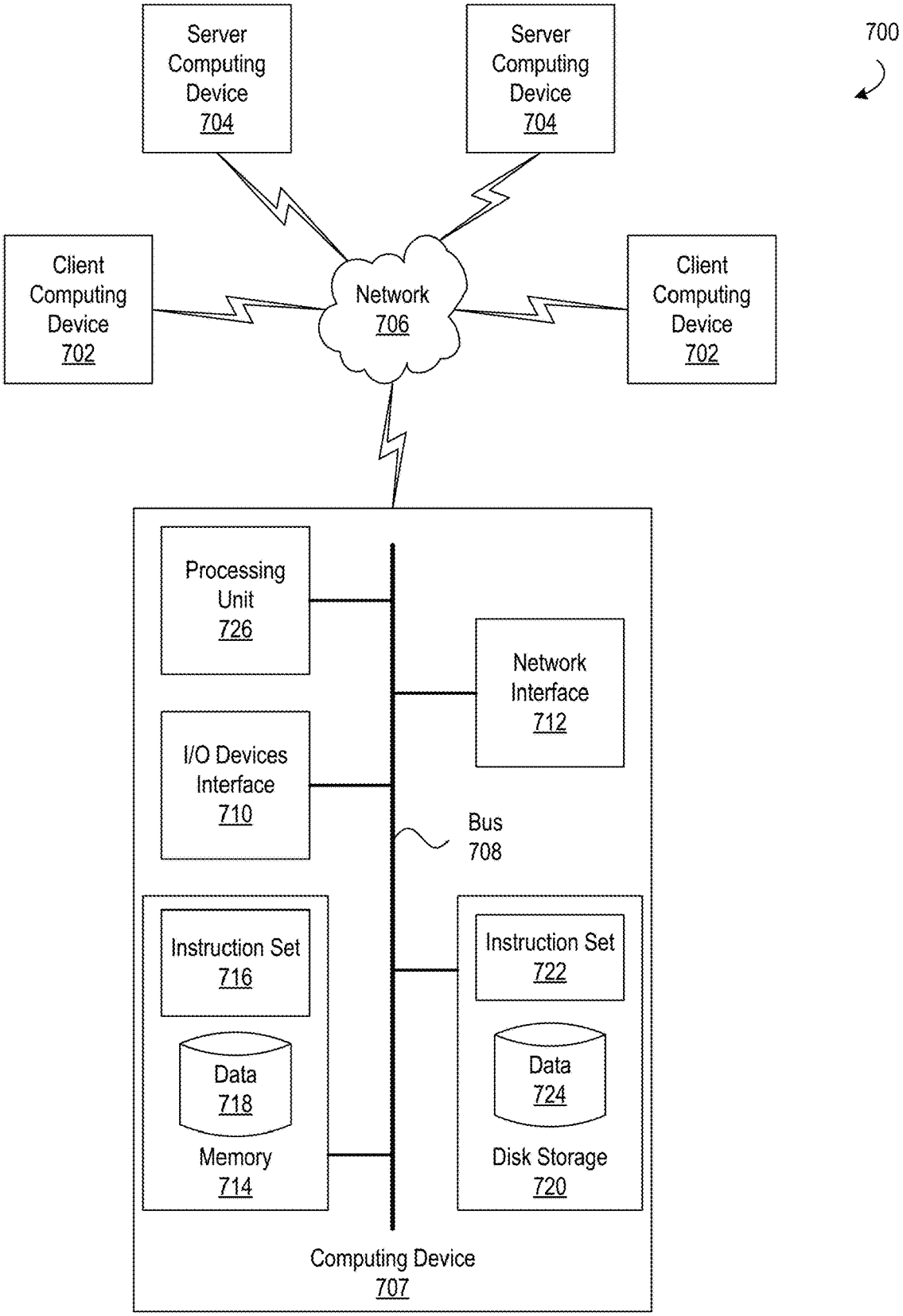
FIG. 7 is a diagram of an example computing environment in which aspects of the present disclosure may be implemented.

Referring now to FIG. 7, an example of an implementation of a computing environment 700 in which aspects of the present disclosure may be implemented is shown. The computing environment may include both client computing devices 702 and server computing devices 704. The client computing devices 702 may include the access control devices (e.g., access control devices 114*a*—e in FIG. 1) and access control bridge devices (e.g., access control bridge devices 116*a*—b in FIG. 1) of an access control system (e.g., access control system 100 in FIG. 1). The server computing devices 704 may include an access control server (e.g., access control server 118 in FIG. 2).

The client computing devices 702 and server computing devices 704 may provide processing, storage, input/output devices, application programs, and the like. Client computing devices 702 may include, e.g., desktop computers, laptop computers, tablet computers, palmtop computers, smartphones, smart televisions, and the like. Client computing devices 702 may also be in signal communication to other computing devices, including other client computing devices 702 and server computing devices 704 via a network 706. The network 706 may be part of a remote access network, a wide area network (e.g., the Internet), a cellular network, a worldwide collection of computers, local area networks, and gateways that currently use respective protocols (e.g., FTP, HTTP, TCP/IP, etc.) to communicate with one another. Other electronic device architectures and computer network architectures may be selectively employed.

FIG. 7 also depicts a block diagram of one computing device 707 of the computing environment 700. The computing device 707 contains a bus 708 the computing device utilizes to transfer information among its components. The bus 708 connects different components of the computing device 707 (e.g., one or more processors, disk storage, memory, input/output ports, network ports, etc.) and enables the transfer of information between those components. An I/O device interface 710 is connected to the bus 708. The I/O device interface 710 connects various input and output devices (e.g., keyboard, mouse, microphone, camera, displays, printers, speakers, etc.) to the computing device 707. A network interface 712 is also attached to the bus 708 and enables the computing device 707 to connect to various other devices attached to a network (e.g., network 706). The memory 714 provides volatile storage for one or more instruction sets 716 and data 718 used to implement aspects described herein. Disk storage 720 provides non-volatile storage for one or more instruction sets 722 (e.g., an operating system) and data 724 used to implement various aspects described herein. The processing unit 726 is also attached to the bus 708 and executes the instructions stored in the memory 714 and/or the disk storage 720. The instruction sets 716 and 722 as well as the data 718 and 724 include a computer program product, including a computer-readable medium (e.g., a removable storage medium such as one or more DVD-ROM's, CD-ROM's, diskettes, tapes, etc.) that provides at least a portion of the software instructions for implementing aspects of the present disclosure. At least a portion of the instructions may also be downloaded via the network 706. As noted above, computer-readable media include all non-transitory computer-readable media and do not include transitory propagating signals. The client computing devices 702 and server computing devices 704 may include components that are the same or similar to the components of the computing device 707 discussed above.

One or more aspects of the disclosure may be embodied in computer-usable or readable data and/or computer-executable instructions, such as in one or more program modules, executed by one or more computers or other devices as described herein. Generally, program modules include routines, programs, objects, components, data structures, etc. that perform particular tasks or implement particular abstract data types when executed by a processor in a computer or other device. The modules may be written in a source code programming language that is subsequently compiled for execution, or may be written in a scripting language such as, e.g., HTML, XML, JavaScript, and the like. The executable instructions may be stored on a computer readable medium such as a hard disk, optical disk, removable storage media, solid state memory, RAM, ROM, etc. In some examples, the instructions may be stored on a tangible computer-readable storage medium, which, is expressly defined herein to include storage devices or storage discs and to exclude transmission media and propagating signals. The functionality of the program modules may be combined or distributed as desired in various embodiments. In addition, the functionality may be embodied in whole or in part in firmware or hardware equivalents such as integrated circuits, field programmable gate arrays (FPGAs), and the like. Various data structures may be used to more effectively implement one or more aspects of the disclosure, and such data structures are contemplated to be within the scope of the executable instructions and computer-usable data described herein.

It should be appreciated that, while the disclosures above are described by way of example in the context of a multi-tenant environment, those disclosures are not limited to a multi-tenant environment and may be employed in single-tenant environment. For example, the disclosures above may be employed in a single-tenant environment to control access for different types of users having different levels of access such as, for example, a single-family home with parents and children representing different types of users with different levels of access, a business or other organization with different types of employees or staff, and the like.

Furthermore, whole the disclosures above are described by way of example in the context of access control devices, those disclosures are not limited to access control devices and may be employed to provide access control information for other types of end devices. For example, any type of end device that may be deployed in an access control system, store access control information, and receive and respond to access requests may be employed in addition or as an alternative to the access control devices described above. Examples of such end devices include sensors for measuring various parameters associated with the surrounding environment such as for example, acoustic and optical sensors, chemical sensors (e.g., oxygen, carbon dioxide, carbon monoxide, smoke, etc.), electric and magnetic sensors, electromagnetic radiation sensors, temperature sensors, force and pressure sensors, moisture and fluid flow sensors, air and air flow sensors, velocity and acceleration sensors, position and displacement sensors, proximity and motion sensors, and the like; activation-type device nodes that include actuators, solenoids, and/or output devices that are operable in response to receipt of commands such as, for example, optical output devices (e.g., lights, display devices, and the like), audio output devices (e.g., speakers, alarms, and the like); computing devices; and the like. Examples of access requests may include a request to receive or otherwise access a sensor reading, a request to perform some physical action, a request to perform some logical action, and the like. Accordingly, an access control system may include any combination of access control devices, sensors, actuation-type devices, or computing devices that may be desirable to deploy at a location.

Aspects of the disclosure have been described in terms of illustrative embodiments thereof. While illustrative systems, devices, and methods as described herein embodying various aspects of the present disclosure are shown, it will be understood that the disclosure is not limited to these embodiments. Modifications may be made particularly in light of the foregoing teachings. For example, the steps illustrated in the illustrative figures may be performed in other than the recited order, and one or more steps illustrated may be optional in accordance with aspects of the disclosure. It will also be appreciated and understood that modifications may be made without departing from the true spirit and scope of the present disclosure. The description is thus to be regarded as illustrative instead of restrictive on the present disclosure.

What is claimed is:

1. A method comprising, by an access control server:

sending, using an access control communication protocol and to an access control bridge device that provides wireless coverage at a location, access control information associated with a plurality of access control devices that provide access control at the location, wherein the access control information comprises:

first tenant-specific access control information associated with a first tenant-specific access control device, of the plurality of access control devices, that provides access control to a first private area of the location that is associated with a first tenant;

second tenant-specific access control information associated with a second tenant-specific access control device, of the plurality of access control devices, that provides access control to a second private area of the location that is associated with a second tenant; and shared access control information associated with a shared access control device, of the plurality of access control devices, that provides access control to a common area of the location;

receiving, from the access control bridge device based on a first request for access received at the location and based on one or more modifiable configuration settings, a second request to perform at least one access control procedure, wherein the one or more modifiable configuration settings indicate that the at least one access control procedure is to be performed by at least one of the access control server, the access control bridge device, or one or more access control devices of the plurality of access control devices;

performing the at least one access control procedure; and sending, based on one or more results of the at least one access control procedure, an indication of whether to grant or deny access at the location.

2. The method of claim 1, further comprising receiving, using the access control communication protocol and from the access control bridge device, a third request for at least a portion of the access control information, wherein the sending the access control information comprises sending, based on receipt of the third request, the portion of the access control information requested.

3. The method of claim 1, wherein the sending comprises pushing, using the access control communication protocol and to the access control bridge device, at least a portion of the access control information.

4. The method of claim 1, further comprising determining, based on the one or more modifiable configuration settings, that the at least one access control procedure is to be performed by the access control server, wherein the performing the at least one access control procedure is based on the determining.

5. The method of claim 1, wherein the shared access control information comprises at least a portion of the first tenant-specific access control information and at least a portion of the second tenant-specific access control information.

6. The method of claim 1, wherein the at least one access control procedure comprises at least one of authentication or authorization.

7. The method of claim 1, wherein:

the location comprises a physical structure;

the first tenant-specific access control device comprises a first electronic lock that controls access to the first private area via a first door of the physical structure;

the second tenant-specific access control device comprises a second electronic lock that controls access to the second private area via a second door of the physical structure; and the shared access control device comprises a third electronic lock that controls access to the physical structure via a third door of the physical structure.

8. The method of claim 1, wherein:

one or more first users associated with the first tenant comprises one or more of a first employee of the first tenant, a first guest of the first tenant, or a manager of the location; and one or more second users associated with the second tenant comprises one or more of a second employee of the second tenant, a second guest of the second tenant, or a manager of the location.

9. The method of claim 1, further comprising sending, using the access control communication protocol and to the access control bridge device, one or more of:

one or more access control rules indicated by the access control information;

one or more access control schedules indicated by the access control information;

indication of one or more user groups indicated by the access control information;

indication of one or more access control device groups indicated by the access control information; or indication of one or more access control device updates indicated by the access control information.

10. An access control server comprising:

one or more processors;

a data store comprising access control information associated with a plurality of access control devices that provide access control at a location, wherein the access control information comprises:

first tenant-specific access control information associated with a first tenant-specific access control device, of the plurality of access control devices, that provides access control to a first private area of the location that is associated with a first tenant at the location;

second tenant-specific access control information associated with a second tenant-specific access control device, of the plurality of access control devices, that provides access control to a second private area of the location that is associated with a second tenant at the location; and shared access control information associated with a shared access control device, of the plurality of access control devices, that provides access control to a common area of the location; and memory storing instructions that, when executed by the one or more processors, cause the access control server to, based on a first request for access received at the location and a second request to perform at least one access control procedure received from an access control bridge device and based on one or more modifiable configuration settings indicating at least one access control procedure to be performed by at least one of the access control server, the access control bridge device, or one or more access control devices of the plurality of access control devices:

perform the at least one access control procedure; and send to the access control bridge device, based one or more results of the at least one access control procedure and using an access control communication protocol, an indication of whether to grant or deny access at the location.

11. The access control server of claim 10, wherein the memory storing instructions, when executed by the one or more processors, further cause the access control server to, based on receipt of a third request received from an access control bridge device for at least a portion of the access control information, send the portion of the access control information to the access control bridge device using the access control communication protocol.

12. The access control server of claim 10, wherein the instructions, when executed, further cause the access control server to push, using the access control communication protocol, at least a portion of the access control information to the access control bridge device.

13. The access control server of claim 10, wherein the instructions, when executed, further cause the access control server to determine, based on the one or more modifiable configuration settings, that the at least one access control procedure is to be performed by the access control server.

14. The access control server of claim 10, wherein the shared access control information comprises at least a portion of the first tenant-specific access control information and at least a portion of the second tenant-specific access control information.

15. The access control server of claim 10, wherein the at least one access control procedure comprises at least one of authentication or authorization.

16. The access control server of claim 10, wherein:

the location comprises a physical structure;

the first tenant-specific access control device comprises a first electronic lock that controls access to the first private area via a first door of the physical structure;

the second tenant-specific access control device comprises a second electronic lock that controls access to the second private area via a second door of the physical structure; and the shared access control device comprises a third electronic lock that controls access to the physical structure via a third door of the physical structure.

17. The access control server of claim 10, wherein:

one or more first users associated with the first tenant comprises one or more of a first employee of the first tenant, a first guest of the first tenant, or a manager of the location; and one or more second users associated with the second tenant comprises one or more of a second employee of the second tenant, a second guest of the second tenant, or a manager of the location.

18. The access control server of claim 10, wherein the access control bridge device is configured to selectively obtain, from the access control server and using the access control communication protocol:

one or more access control rules indicated by the access control information;

one or more access control schedules indicated by the access control information;

indication of one or more user groups indicated by the access control information;

indication of one or more access control device groups indicated by the access control information; or indication of one or more access control device updates indicated by the access control information.

19. A non-transitory computer-readable storage medium having computer-executable instructions stored thereon that, when executed by one or more processors of an access control server, cause the access control server to:

send, using an access control communication protocol and to an access control bridge device that provides wireless coverage at a location, access control information associated with a plurality of access control devices that provide access control at the location, wherein the access control information comprises:

first tenant-specific access control information associated with a first tenant-specific access control device, of the plurality of access control devices, that provides access control to a first private area of the location that is associated with a first tenant;

second tenant-specific access control information associated with a second tenant-specific access control device, of the plurality of access control devices, that provides access control to a second private area of the location that is associated with a second tenant; and shared access control information associated with a shared access control device, of the plurality of access control devices, that provides access control to a common area of the location;

receive, from the access control bridge device based on a first request for access received at the location and based on one or more modifiable configuration settings, a second request to perform at least one access control procedure, wherein the one or more modifiable configuration settings indicate that the at least one access control procedure is to be performed by at least one of the access control server, the access control bridge device, or one or more access control devices of the plurality of access control devices;

perform the at least one access control procedure; and send, based on one or more results of the at least one access control procedure, an indication of whether to grant or deny access at the location.

20. The non-transitory computer-readable storage medium of claim 19, wherein the instructions, when executed, further cause the access control server to:

receive, using the access control communication protocol and from the access control bridge device, a third request for at least a portion of the access control information; and send, based on receipt of the third request, the portion of the access control information requested.

21. The non-transitory computer-readable storage medium of claim 19, wherein the instructions, when executed, further cause the access control server to:

push, using the access control communication protocol, at least a portion of the access control information to the access control bridge device.

22. The non-transitory computer-readable storage medium of claim 19, wherein the instructions, when executed, further cause the access control server to:

determine, based on the one or more modifiable configuration settings, that the at least one access control procedure is to be performed by the access control server.

23. The non-transitory computer-readable storage medium of claim 19, wherein the shared access control information comprises at least a portion of the first tenant-specific access control information and at least a portion of the second tenant-specific access control information.

24. The non-transitory computer-readable storage medium of claim 19, wherein the at least one access control procedure comprises at least one of authentication or authorization.

25. The non-transitory computer-readable storage medium of claim 19, wherein:

the location comprises a physical structure;

the first tenant-specific access control device comprises a first electronic lock that controls access to the first private area via a first door of the physical structure;

the second tenant-specific access control device comprises a second electronic lock that controls access to the second private area via a second door of the physical structure; and the shared access control device comprises a third electronic lock that controls access to the physical structure via a third door of the physical structure.

26. The non-transitory computer-readable storage medium of claim 19, wherein:

one or more first users associated with the first tenant comprises one or more of a first employee of the first tenant, a first guest of the first tenant, or a manager of the location; and one or more second users associated with the second tenant comprises one or more of a second employee of the second tenant, a second guest of the second tenant, or a manager of the location.

27. The non-transitory computer-readable storage medium of claim 19, wherein the instructions, when executed, further cause the access control server to send, using the access control communication protocol and to the access control bridge device, one or more of:

one or more access control rules indicated by the access control information;

one or more access control schedules indicated by the access control information;

indication of one or more user groups indicated by the access control information;

indication of one or more access control device groups indicated by the access control information; or indication of one or more access control device updates indicated by the access control information.

28. A non-transitory computer-readable storage medium having computer-executable instructions stored thereon that, when executed by one or more processors of an access control bridge device, cause the access control bridge device to:

obtain, from an access control server using an access control communication protocol, access control information associated with a plurality of access control devices that provide access control at a location, wherein the access control information comprises:

first tenant-specific access control information associated with a first tenant-specific access control device, of the plurality of access control devices, that provides access control to a first private area of the location that is associated with a first tenant;

second tenant-specific access control information associated with a second tenant-specific access control device, of the plurality of access control devices, that provides access control to a second private area of the location that is associated with a second tenant; and shared access control information associated with a shared access control device, of the plurality of access control devices, that provides access control to a common area of the location;

storing the access control information obtained;

configure the first tenant-specific access control device to grant access to only one or more first users associated with the first tenant at least by sending, to the first tenant-specific access control device, the first tenant-specific access control information;

configure the second tenant-specific access control device to grant access to only one or more second users associated with the second tenant at least by sending, to the second tenant-specific access control device, the second tenant-specific access control information; and configure the shared access control device to grant access to the one or more first users and the one or more second users by sending, to the shared access control device, the shared access control information; and receive indication of one or more modifiable configuration settings that indicate at least one access control procedure is to be performed, based on a request for access received at the location, by at least one of the access control server, the access control bridge device, or one or more access control devices of the plurality of access control devices.

29. The non-transitory computer-readable storage medium of claim 28, wherein the shared access control information comprises at least a portion of the first tenant-specific access control information and at least a portion of the second tenant-specific access control information.

30. The non-transitory computer-readable storage medium of claim 28, wherein the at least one access control procedure comprises at least one of authentication or authorization.

31. The non-transitory computer-readable storage medium of claim 28, wherein the instructions, when executed, further cause, based on the one or more modifiable configuration settings indicating an access control procedure of the at least one access control procedure is to be performed by the access control bridge device, the access control bridge device to:

perform the access control procedure; and indicate, to at least one of the first tenant-specific access control device, the second tenant-specific access control device, or the shared access control device, whether to grant or deny access at the location.

32. The non-transitory computer-readable storage medium of claim 28, wherein the instructions, when executed, further cause the access control bridge device to:

receive, from the access control server, an indication of whether to grant or deny access at the location; and indicate, to at least one of the first tenant-specific access control device, the second tenant-specific access control device, or the shared access control device, whether to grant or deny access at the location.

33. The non-transitory computer-readable storage medium of claim 28, wherein the instructions, when executed, further cause the access control bridge device to:

receive, by the access control bridge device, an indication that one or more access control procedures of the at least one access control procedure is to be performed by the access control bridge device.

34. The non-transitory computer-readable storage medium of claim 28, wherein:

the location comprises a physical structure;

the first tenant-specific access control device comprises a first electronic lock that controls access to the first private area via a first door of the physical structure;

the second tenant-specific access control device comprises a second electronic lock that controls access to the second private area via a second door of the physical structure; and the shared access control device comprises a third electronic lock that controls access to the physical structure via a third door of the physical structure.

35. The non-transitory computer-readable storage medium of claim 28, wherein:

the one or more first users associated with the first tenant comprises one or more of a first employee of the first tenant, a first guest of the first tenant, or a manager of the location; and the one or more second users associated with the second tenant comprises one or more of a second employee of the second tenant, a second guest of the second tenant, or a manager of the location.

36. The non-transitory computer-readable storage medium of claim 28, wherein the instructions, when executed, further cause the access control bridge device to:

selectively obtain, from the access control server and using the access control communication protocol, one or more access control rules indicated by the access control information, one or more access control schedules indicated by the access control information, indication of one or more user groups indicated by the access control information, indication of one or more access control device groups indicated by the access control information, and indication of one or more access control device updates indicated by the access control information.

* * * * *